US007532168B2

(12) United States Patent
Nakanishi et al.

(10) Patent No.: US 7,532,168 B2
(45) Date of Patent: May 12, 2009

(54) FOLDING PORTABLE WIRELESS UNIT

(75) Inventors: Seiichi Nakanishi, Toyama (JP); Yoshio Koyanagi, Kanagawa (JP); Kouta Aoki, Kanagawa (JP); Nozomi Koh, Kanagawa (JP); Yutaka Saito, Ishikawa (JP); Kenya Nagano, Ishikawa (JP)

(73) Assignee: Panasonic Corporation, Osaka (JP)

( * ) Notice: Subject to any disclaimer, the term of this patent is extended or adjusted under 35 U.S.C. 154(b) by 302 days.

(21) Appl. No.: 11/569,260

(22) PCT Filed: May 23, 2005

(86) PCT No.: PCT/JP2005/009814

§ 371 (c)(1),
(2), (4) Date: Nov. 17, 2006

(87) PCT Pub. No.: WO2005/114779

PCT Pub. Date: Dec. 1, 2005

(65) Prior Publication Data

US 2007/0194997 A1 Aug. 23, 2007

(30) Foreign Application Priority Data

May 24, 2004 (JP) ..... 2004-152806

(51) Int. Cl.
*H01Q 1/24* (2006.01)

(52) U.S. Cl. ..... 343/702; 343/725

(58) Field of Classification Search ..... 343/702, 343/725, 729; 379/433.01

See application file for complete search history.

(56) References Cited

U.S. PATENT DOCUMENTS 6,246,374 B1 6/2001 Perrotta et al.
7,253,773 B2 * 8/2007 Chiba et al. ..... 343/702
7,403,164 B2 * 7/2008 Sanz et al. ..... 343/702
2002/0169010 A1 11/2002 Shoji et al.
2004/0027298 A1 2/2004 Iguchi et al.

(Continued)

FOREIGN PATENT DOCUMENTS

EP 1 329 985 A2 7/2003

(Continued)

OTHER PUBLICATIONS

Supplementary European Search Report for Application No. EP 05 74 3558 dated Apr. 16, 2008.

(Continued)

*Primary Examiner*—HoangAnh T Le
(74) *Attorney, Agent, or Firm*—RatnerPrestia

(57) ABSTRACT

A conductive metal frame attached to an upper case is electrically connected to hinge metal member. The hinge metal member is connected to a hinge metal member by a rotary shaft in a rotatable manner. The hinge metal member, a further hinge metal member, and the rotary shaft are made of conductive metal so that electric continuity is obtained at contact points thereamong. The further hinge metal member is connected to a matching circuit on a circuit board via a feedpoint terminal. A conductor element is connected to a ground pattern of the circuit board at a position close to a point at which the matching circuit is grounded. The structure as described above provides a folding portable wireless unit that can secure a high antenna performance in a calling state and a waiting state.

7 Claims, 8 Drawing Sheets

U.S. PATENT DOCUMENTS

| | | | | |
|---|---|---|---|---|
| 2005/0219129 | A1* | 10/2005 | Harano | 343/702 |
| 2005/0275596 | A1* | 12/2005 | Harano | 343/702 |
| 2006/0028380 | A1* | 2/2006 | Harano | 343/702 |
| 2006/0092084 | A1* | 5/2006 | Sakurai | 343/702 |

FOREIGN PATENT DOCUMENTS

| | | |
|---|---|---|
| JP | 2000-036702 | 2/2000 |
| JP | 2001-156898 | 6/2001 |
| JP | 2002-335180 | 11/2002 |
| JP | 2003-273767 | 9/2003 |
| JP | 2004-007310 | 1/2004 |
| JP | 2004-072605 | 3/2004 |
| WO | WO 2004/010530 A1 | 1/2004 |

OTHER PUBLICATIONS

International Search Report for application No. PCT/JP2005/009814 dated Jun. 28, 2005.

* cited by examiner

FOLDING PORTABLE WIRELESS UNIT

THIS APPLICATION IS A U.S. NATIONAL PHASE APPLICATION OF PCT INTERNATIONAL APPLICATION PCT/JP2005/009814.

TECHNICAL FIELD

The present invention relates to a folding portable wireless unit using an internal antenna.

BACKGROUND ART

A folding mobile telephone is generally has a structure in which an upper case is connected to a lower case via a hinge section so that the structure can be opened or closed. This structure can take two states of an open state and a close state. Thus, this structure has two advantages. One advantage is that a display screen can be increased by allowing the folding mobile telephone to be used while being opened. The other advantage is that the compact shape allows the mobile telephone in a close state to be carried easily.

A known conventional antenna for a folding portable wireless unit is disclosed in Japanese Patent Unexamined Publication No. 2001-156898 and Japanese Patent Unexamined Publication No. 2002-335180. In the conventional structure, an upper case includes therein an antenna element so that this antenna element is fed with power via a feeder passing through a hinge section. A lower case includes therein a ground pattern on a circuit board that functions as a lower antenna element.

However, in the above conventional folding portable wireless unit, antenna current flows in the entire lower case. Thus, this conventional structure has been involved with a problem in that the antenna performance deteriorates when the lower case in a calling state is gripped by a user.

Furthermore, main polarized wave according to an antenna radiation characteristic of the above conventional folding portable wireless unit flows in the longitudinal direction of the case. Thus, when the folding portable wireless unit in the calling state is retained while having an inclination, the main polarized wave is almost horizontal to ground surface. This has caused a problem in which the direction of the main polarized wave does not coincide with a generally vertical polarization wave from a base station antenna, thus causing deteriorated communication quality.

Furthermore, in a waiting state in which the structure having the upper case and the lower case is closed, the above conventional folding portable wireless unit is provided such that the antenna element in the upper case is in the vicinity of the circuit board of the lower case while the former is in parallel with the latter. This deteriorates the radiation resistance to deteriorate the antenna performance.

SUMMARY OF THE INVENTION

The present invention has been made in view of the above problem. It is an objective of the present invention to provide a folding portable wireless unit that can secure a high antenna performance both in a calling state and a waiting state.

The folding portable wireless unit of the present invention includes: an upper case antenna element provided in the upper case; a feedpoint means for feeding with power from a circuit board provided in the lower case to the upper case antenna element; and a conductor element having an electrical length resonant with an operating frequency. The folding portable wireless unit is structured so that: one end of the conductor element is electrically connected to a ground pattern of the circuit board; and the other end of the conductor element is open. This structure can secure a high antenna performance in a calling state.

In the folding portable wireless unit of the present invention, the conductor element is provided in the vicinity of an upper end of a lower case of the folding portable wireless unit.

This structure can secure a high antenna performance in a calling state.

In the folding portable wireless unit of the present invention, the conductor element is provided in parallel with a width direction of the folding portable wireless unit.

This structure can secure a further higher antenna performance in a calling state because the direction of a main polarized wave is in the width direction of the case.

The folding portable wireless unit of the present invention uses a hinge section conductor as a means for feeding with power to the upper case antenna element. A side end of the hinge section conductor includes a feedpoint section; and the other side end of the hinge section conductor is electrically connected with a ground pattern of the circuit board via a reactance element set to have a predetermined value.

This structure can secure a high antenna performance in a calling state.

The folding portable wireless unit of the present invention also includes: a sub antenna element that functions as an antenna in a state where the cases are closed and that is provided in the vicinity of a hinge section; and a means for short-circuiting the sub antenna element to a ground pattern of the circuit board.

This structure can secure a further higher antenna performance in a calling state.

The folding portable wireless unit of the present invention also includes a means for short-circuiting the feedpoint section to a ground pattern of the circuit board.

This structure can secure a high antenna performance in a state where the cases are closed.

The folding portable wireless unit of the present invention also includes a communication quality detector for detecting a communication quality of a wireless circuit section; and a control means that switches, based on the detection result by the communication quality detector, the sub antenna element to be short-circuited to a ground pattern of the circuit board or the feedpoint section to be short-circuited to a ground pattern of the circuit board.

This structure can secure a high antenna performance both in a calling state and a state where the cases are closed.

The folding portable wireless unit of the present invention also includes an open/close detection means for detecting an open or close state of the upper case and the lower case; and a control means that switches, based on the detection result by the open/close detector, the sub antenna element to be short-circuited to a ground pattern of the circuit board or the feedpoint section to be short-circuited to a ground pattern of the circuit board.

This structure can secure a high antenna performance both in a calling state and a state where the cases are closed.

As described above, the present invention provides a high antenna performance in a calling state and also provides a high antenna performance in a waiting state where the upper case and the lower case are closed.

DETAILED DESCRIPTION OF PREFERRED EMBODIMENTS

Hereinafter, a folding portable wireless unit of an embodiment of the present invention will be described with reference to the drawings.

Embodiment 1

Figure 1A:
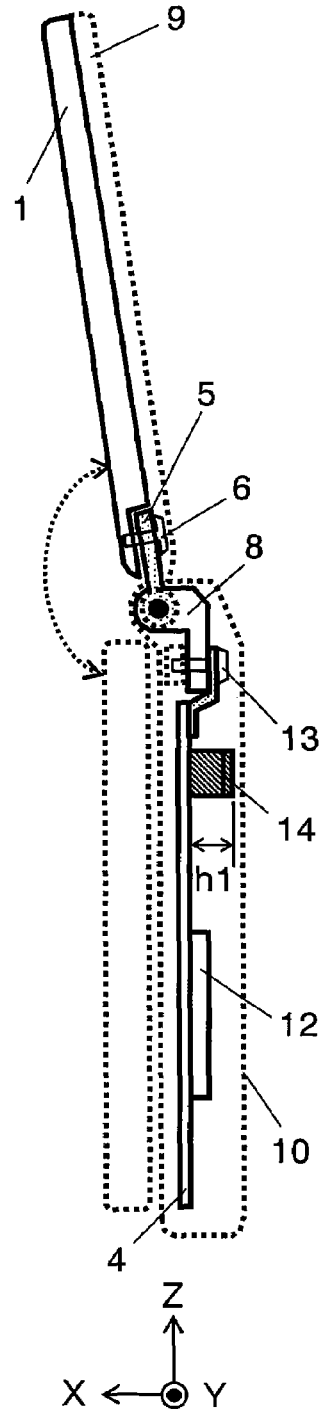
FIG. 1A is a side view illustrating a basic structure of a folding portable wireless unit according to Embodiment 1 of the present invention.
Figure 1B:
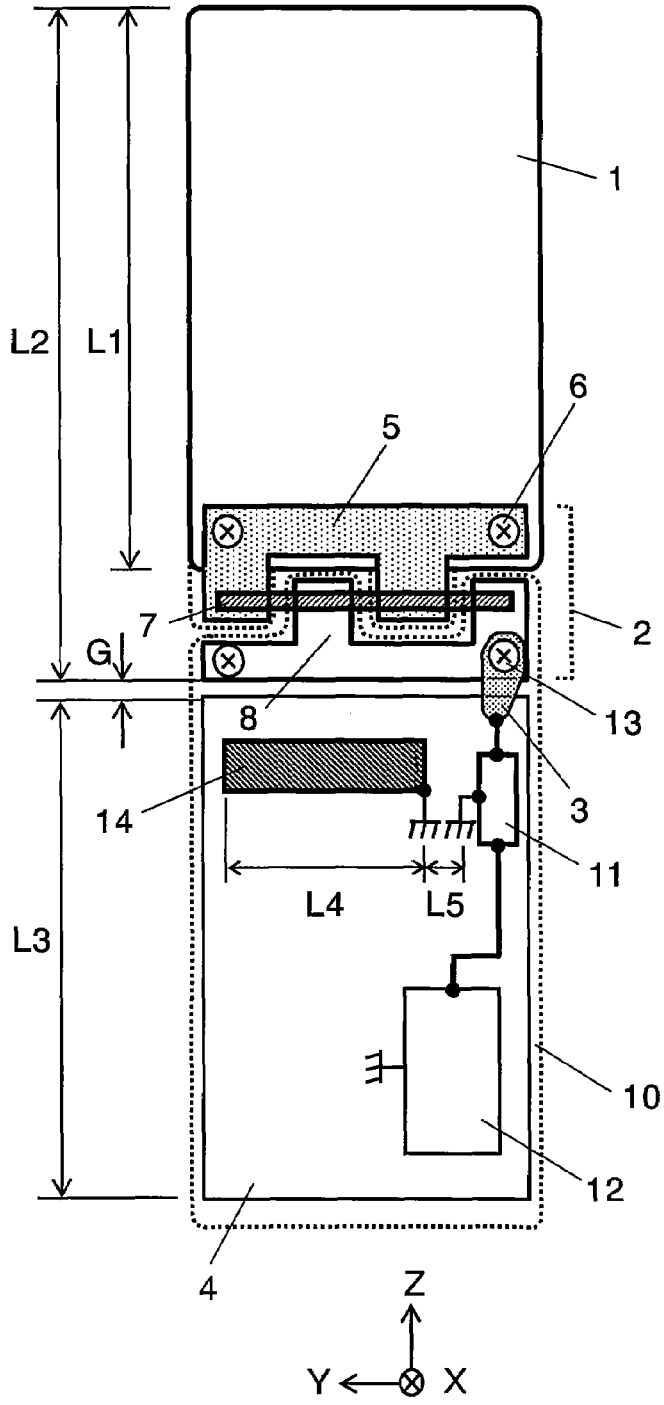
FIG. 1B is a bottom view illustrating a basic structure of the folding portable wireless unit according to Embodiment 1 of the present invention.
Figure 2:
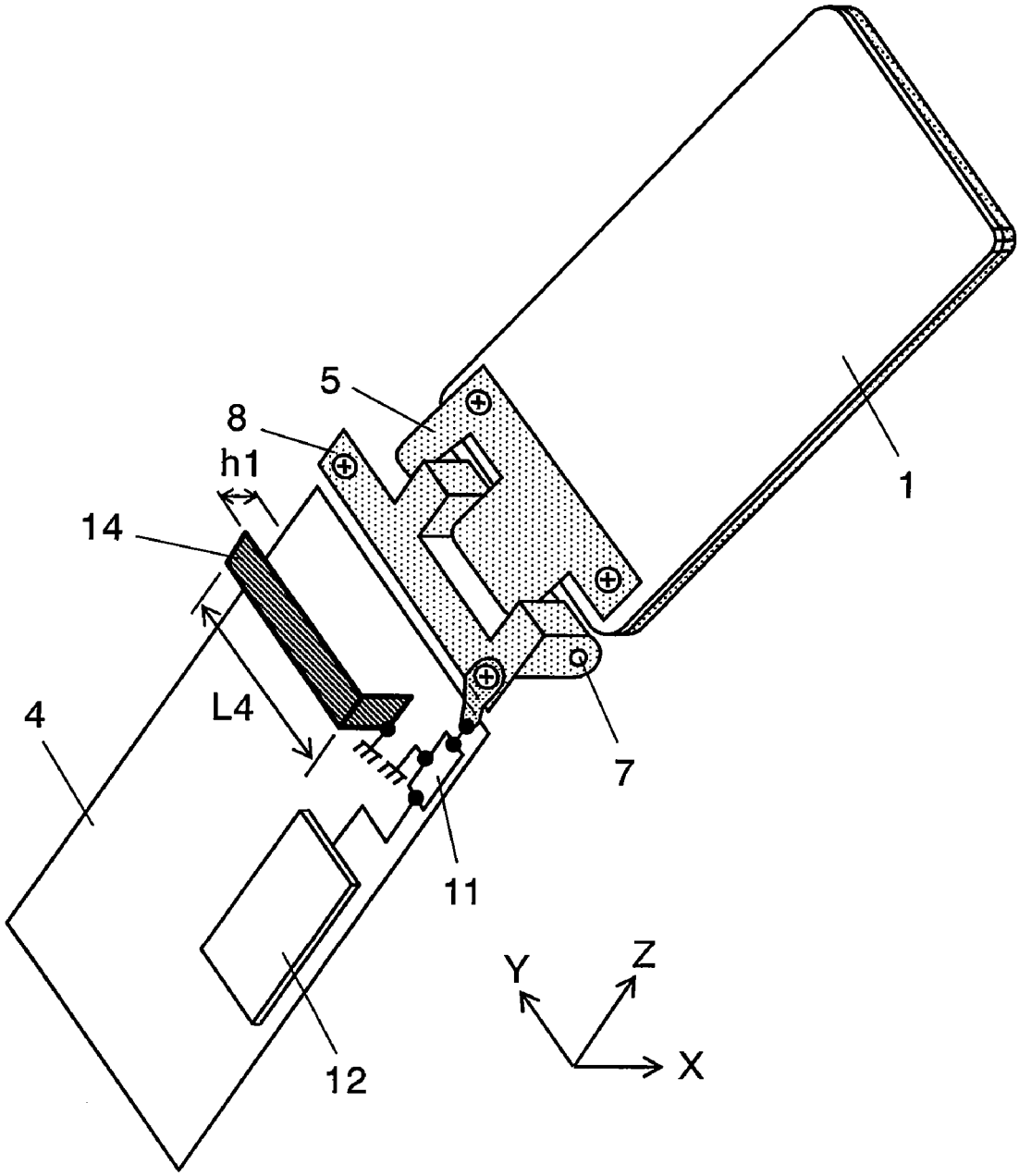
FIG. 2 is a perspective view illustrating the folding portable wireless unit according to Embodiment 1 of the present invention.

FIGS. 1A and 1B and FIG. 2 illustrate a folding portable wireless unit of Embodiment 1 of the present invention.

FIG. 1A is a side view illustrating an internal structure of the folding portable wireless unit of Embodiment 1 of the present invention. FIG. 1B is a bottom view illustrating the internal structure. FIG. 2 is a perspective view illustrating the folding portable wireless unit of Embodiment 1 of the present invention seen from the bottom face.

In FIGS. 1A and 1B, the folding portable wireless unit is provided by a structure in which upper case 9 is connected to lower case 10 via hinge section 2. The folding portable wireless unit may take two states of an open state and a close state by being rotated around hinge section 2. Upper case 9 and lower case 10 are provided by molding resin as insulating material.

A +X-side surface of upper case 9 (i.e., a surface on which a display section is generally provided) is attached with metal frame 1. Metal frame 1 generally is made of metal that has high conductivity, that is light-weight, and that has a high strength (e.g., magnesium alloy). This ensures the strength of upper case 9 having a thin thickness and allows metal frame 1 to function as an antenna element. Metal frame 1 has length L of the long side of about 90 mm.

Metal frame 1 and hinge metal member 5 are attached to upper case 9 by screw 6 to electrically connect metal frame 1 to hinge metal member 5 and to mechanically fix upper case 9 to hinge metal member 5.

Hinge metal member 5 is connected to hinge metal member 8 by rotary shaft 7 corresponding to a connecting section so that hinge metal member 5 and hinge metal member 8 can be rotated. Hinge metal member 5, hinge metal member 8, and rotary shaft 7 are made of conductive metal so that contact points thereamong can provide electrical conductivity. Hinge metal member 5, hinge metal member 8, and rotary shaft 7 constitute hinge section 2 and also constitute a conductor of the hinge section.

A part of hinge metal member 8 and feedpoint terminal 3 are attached to lower case 10 via screw 13 to electrically connect hinge metal member 8 to feedpoint terminal 3 and to mechanically fix lower case 10 to hinge metal member 8.

Feedpoint terminal 3 is connected, by a spring contact or soldering for example, to matching circuit 11 on circuit board 4 provided in lower case 10. Circuit board 4 is a print substrate having thereon circuit members for realizing various functions of a portable wireless unit. On the substantially entire surface of circuit board 4, a ground pattern as a ground potential of the circuit is formed.

Conductor element 14 is formed by an L-shaped steel plate that has length L4 having almost quarter-wave (e.g., about 37 mm in a 2 GHz band). As shown in the perspective view of FIG. 2, one end of conductor element 14 is connected to the ground pattern of circuit board 4 by a spring contact or soldering for example and the other end thereof is open. Conductor element 14 is provided in parallel with circuit board 4 so that distance h1 (e.g., about 5 mm) lies therebetween. Conductor element 14 is also provided in parallel with in a direction of the width of the folding portable wireless unit. Conductor element 14 has a conductor width of about 5 mm for example.

In the folding portable wireless unit having the structure as described above, metal frame 1 and hinge section 2 function as an upper case antenna element having length L2 (e.g., 110 mm). Matching circuit 11 has a function to match an impedance of this upper case antenna element with an input impedance of wireless circuit 12 (generally 50Ω). The ground pattern on circuit board 4 having length L3 (e.g., 90 mm) functions as a lower case antenna element. Specifically, metal frame 1 and hinge section 2 as well as circuit board 4 function as a dipole antenna. In this structure, the antenna performance is desirably secured by maximizing distance G between hinge metal member 8 and ground pattern on circuit board 4 as much as possible (e.g., 2 mm or more).

Distance L5 is a distance between a position at which conductor element 14 is connected to the ground pattern on circuit board 4 and a position at which matching circuit 11 is grounded. Distance L5 is reduced as much as possible (e.g., about 5 mm or less). The structure as described above allows conductor element 14 to function as a quarter-wavelength ground wire.

When conductor element 14 does not exist in this structure, large antenna current flows in the ground pattern on circuit board 4. In this case, in the calling state in which a user retains the lower case by gripping the lower case, an influence by the hand suppresses the radiation from the antenna current distributed on the ground pattern on circuit board 4, thus deteriorating the antenna performance.

Figure 3:
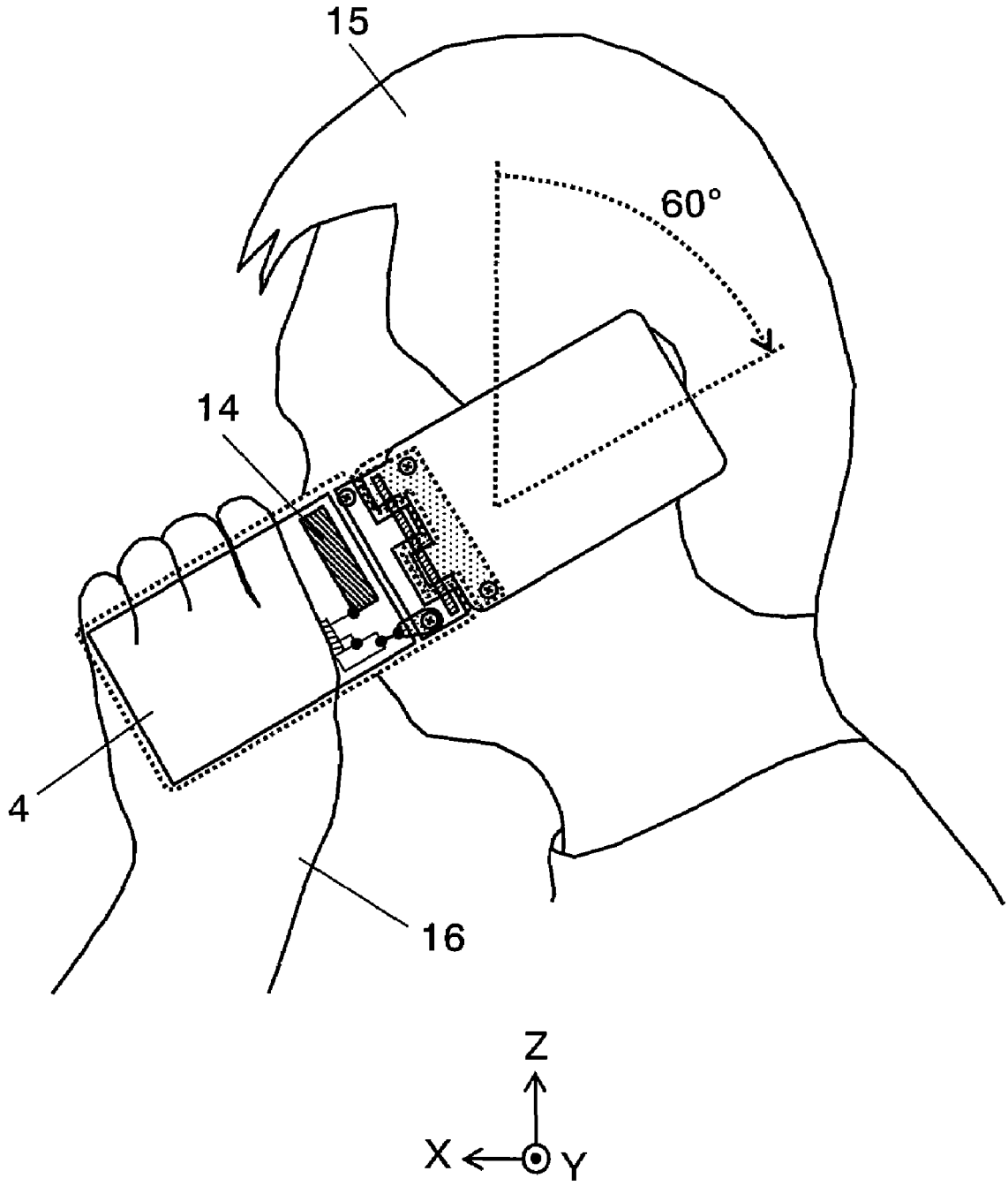
FIG. 3 illustrates the folding portable wireless unit according to Embodiment 1 of the present invention used by a user.

However, in the case of the folding portable wireless unit of Embodiment 1, conductor element 14 functioning as a ground wire allows much of current distributed on the ground pattern on circuit board 4 to be distributed over conductor element 14. When conductor element 14 is provided in the vicinity of an upper end of the lower case, conductor element 14 is gripped by hand 16 of user 15 in the calling state as shown in FIG. 3 with a smaller probability.

Thus, radiation from the antenna current distributed on conductor element 14 is prevented from being suppressed, thus providing a high antenna performance in the calling state.

Conductor element 14 provided in parallel with the width direction of the folding portable wireless unit provides a radiation characteristic of a polarized wave component in the direction Y in FIGS. 1A and 1B. Then, when a general calling state is taken in which the folding portable wireless unit is inclined as shown in FIG. 3 by 60 degrees from the vertex direction, a component in direction Z of the coordinate system of FIG. 3 (i.e., a radiation characteristic of a vertical polarization wave component) is obtained. This provides a high antenna gain in a calling state and can provide an effect, for example, for achieving an improved antenna gain of about 2 dB when compared with a case having no conductor element 14.

Although Embodiment 1 has described conductor element 14 as having quarter-wave length L4, conductor element 14 also may have another length by which antenna current on the circuit board in lower case 10 can be divided to flow in conductor element 14.

Conductor element 14 also may have a width of about 1 mm for example. However, this width of about 1 mm causes a relatively narrow bandwidth of an operating frequency. Thus, conductor element 14 desirably has a wider width because it can increase the bandwidth.

Alternatively, a plurality of conductor elements 14 having different lengths also may be provided in order to achieve a plurality of operating frequencies.

Conductor element 14 is preferably arranged at a position that is gripped by a hand in a calling state with a small probability. More specifically, a ground position of conductor element 14 is desirably close to a ground position of matching circuit 11 because this layout increases current distributed over conductor element 14. Thus, conductor element 14 is desirably arranged at a position as closely as possible to an upper end of lower case 10.

Conductor element 14 effectively functions at a certain level when being provided in a direction along which conductor element 14 is prevented from being gripped by a hand in a calling state. However, conductor element 14 is desirably provided in a direction in parallel with the width direction of the folding portable wireless unit because this layout provides a vertical polarization wave component in a calling state.

Although Embodiment 1 allows metal frame 1 to function as an upper case antenna element, the present invention is not limited to this. Thus, other members also may be used as an antenna element such as conductors such as a circuit board pattern or a shield case provided in upper case 9.

Embodiment 2

Figure 4:
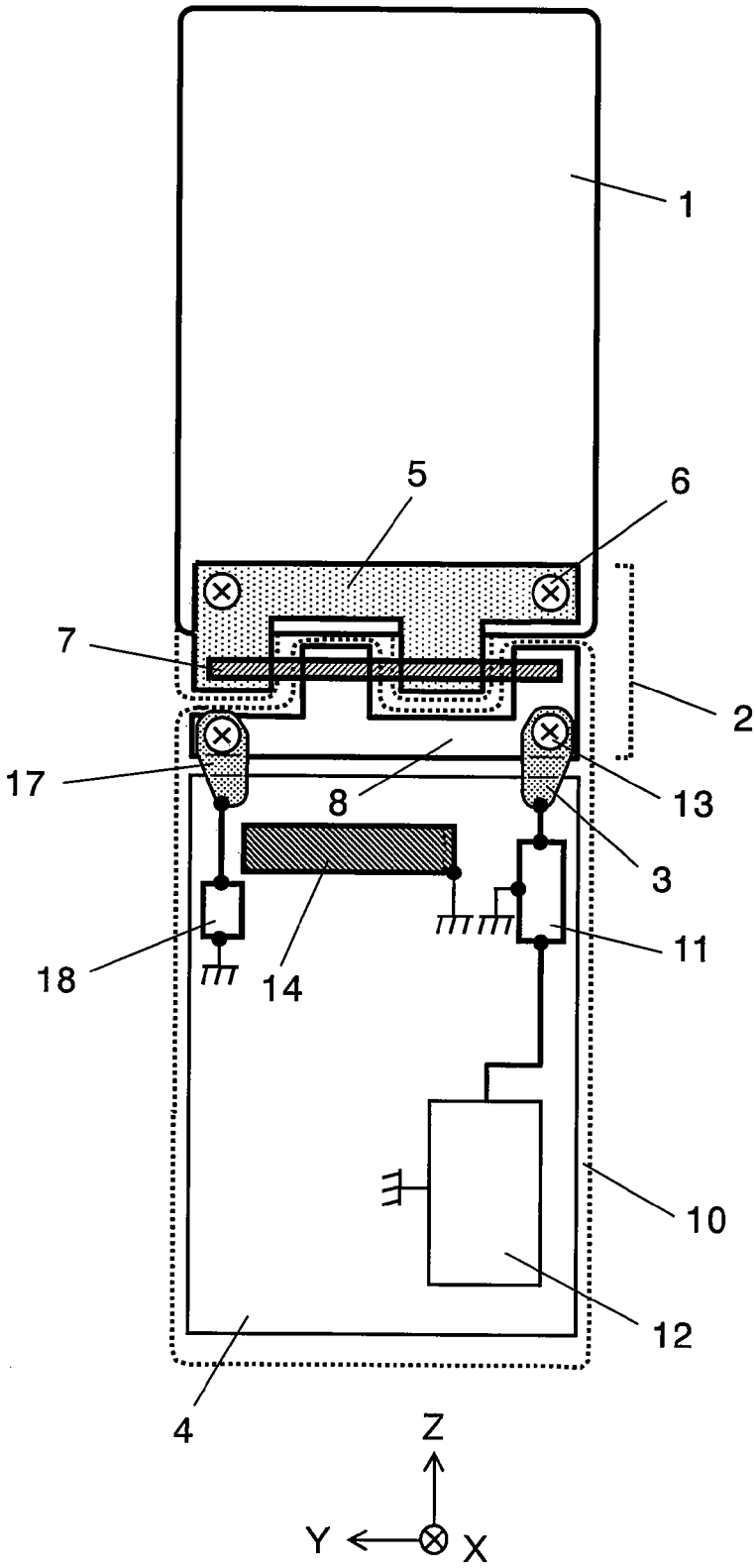
FIG. 4 is a bottom view illustrating a basic structure of a folding portable wireless unit according to Embodiment 2 of the present invention.

FIG. 4 illustrates a folding portable wireless unit of Embodiment 2 of the present invention.

FIG. 4 is a bottom view illustrating an internal structure of the folding portable wireless unit of Embodiment 2 of the present invention.

In FIG. 4, the same constitutional members as those of FIGS. 1A and 1B are denoted with the same reference numerals and will not be described further.

In FIG. 4, hinge metal member 8 is attached with terminals 17 opposed to a side at which feedpoint terminals 3 are connected. Terminal 17 is connected to the ground pattern on the circuit board 4 via reactance element 18.

Reactance element 18 has a capacity value set to have a capacitive value of about 0.5 pF to 10 pF or an inductive value of about 1 nH to 20 nH for example. A change in the value of reactance element 18 can change the phase of antenna current flowing in hinge metal member 8.

By adjusting the value of reactance element 18 to optimize a relation between the phase of antenna current flowing in hinge metal member 8 and the phase of antenna current flowing in conductor element 14, a polarized wave component in direction Y (i.e., radiation in direction Z of a polarized wave component in the width direction of the folding portable wireless unit) can be enhanced. This phenomenon can increase an antenna gain in a calling state.

When the reactance element 18 has a value of 0.5 pF for example, an increase of about 1 dB of an antenna gain in a calling state can be achieved when compared with a case where no reactance element 18 is provided.

Terminal 17 and reactance element 18 may be provided at any position so long as the position can increase the radiation of a polarized wave component in the width direction from the folding portable wireless unit. The radiation can be effectively increased when terminal 17 and reactance element 18 are provided at a position in the width direction of the folding portable wireless unit with away as much as possible from the position of feedpoint terminal 3 (i.e., feedpoint).

Although the above effect by the addition of reactance element 18 can be provided even when conductor element 14 does not exist, this effect is increased when element 14 and reactance element 18 are both added and used.

Embodiment 3

Figure 5A:
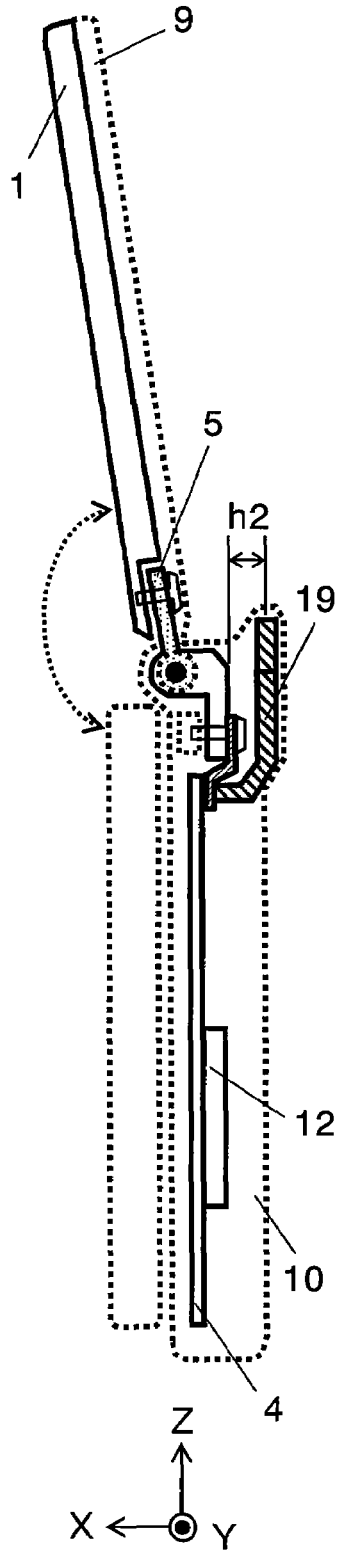
FIG. 5A is a side view illustrating a basic structure of a folding portable wireless unit according to Embodiment 3 of the present invention.
Figure 5B:
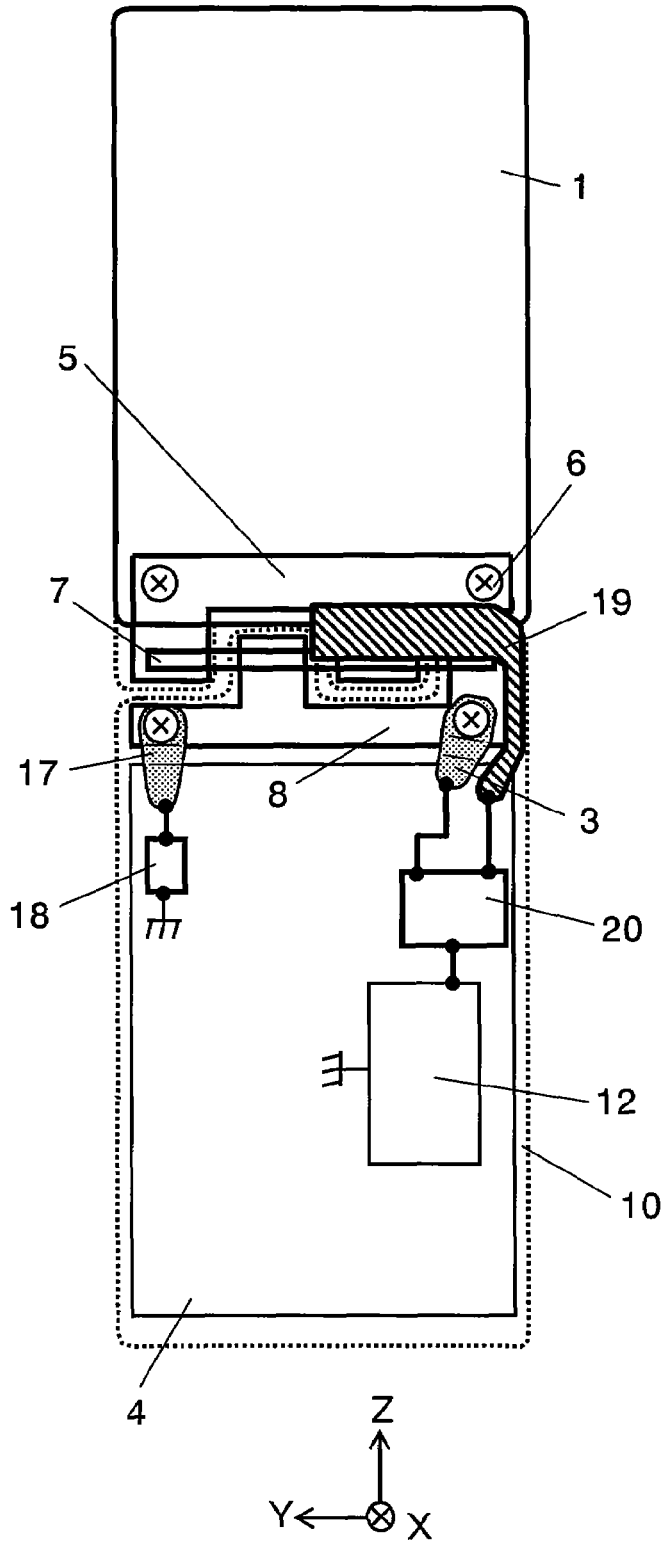
FIG. 5B is a bottom view illustrating a basic structure of the folding portable wireless unit of Embodiment 3 of the present invention.
Figure 6:
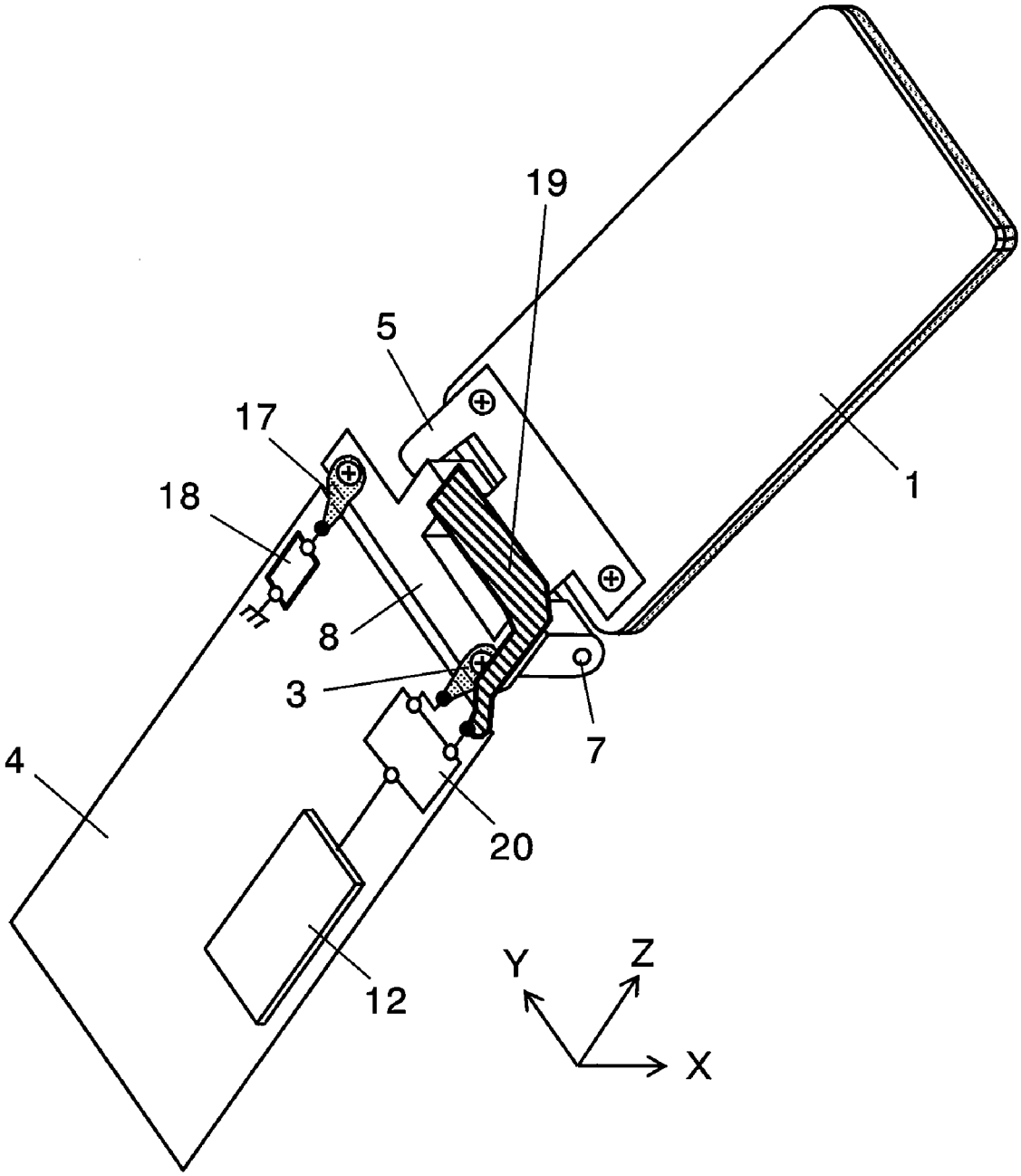
FIG. 6 is a perspective view illustrating the folding portable wireless unit of Embodiment 3 of the present invention.

FIGS. 5A and 5B and FIG. 6 illustrate a folding portable wireless unit of Embodiment 3 of the present invention. FIG. 5A is a side view illustrating an internal structure of the folding portable wireless unit of Embodiment 3 of the present invention. FIG. 5B is a bottom view illustrating the internal structure.

FIG. 6 is a perspective view illustrating the folding portable wireless unit of Embodiment 3 of the present invention seen from the bottom face.

In FIGS. 5A and 5B and FIG. 6, the same constitutional members as those of FIGS. 1A and 1B, FIG. 2, and FIG. 4 are denoted with the same reference numerals and will not be described further.

The folding portable wireless unit of Embodiment 3 of the present invention includes a sub antenna element. In FIGS. 5A and 5B, antenna element 19 is a sub antenna element that is made of a conductive steel plate and has a length that is almost quarter-wave of the operating frequency (about 37 mm in a 2 GHz band). Antenna element 19 is provided so that the distance h2 lies between antenna element 19 and hinge metal member 8. As shown in the perspective view of FIG. 6, antenna element 19 is provided in the vicinity of a hinge section.

Antenna element 19 and feedpoint terminal 3 are selected by antenna control circuit section 20 mounted on circuit board 4 to be connected to wireless circuit 12.

Figure 7:
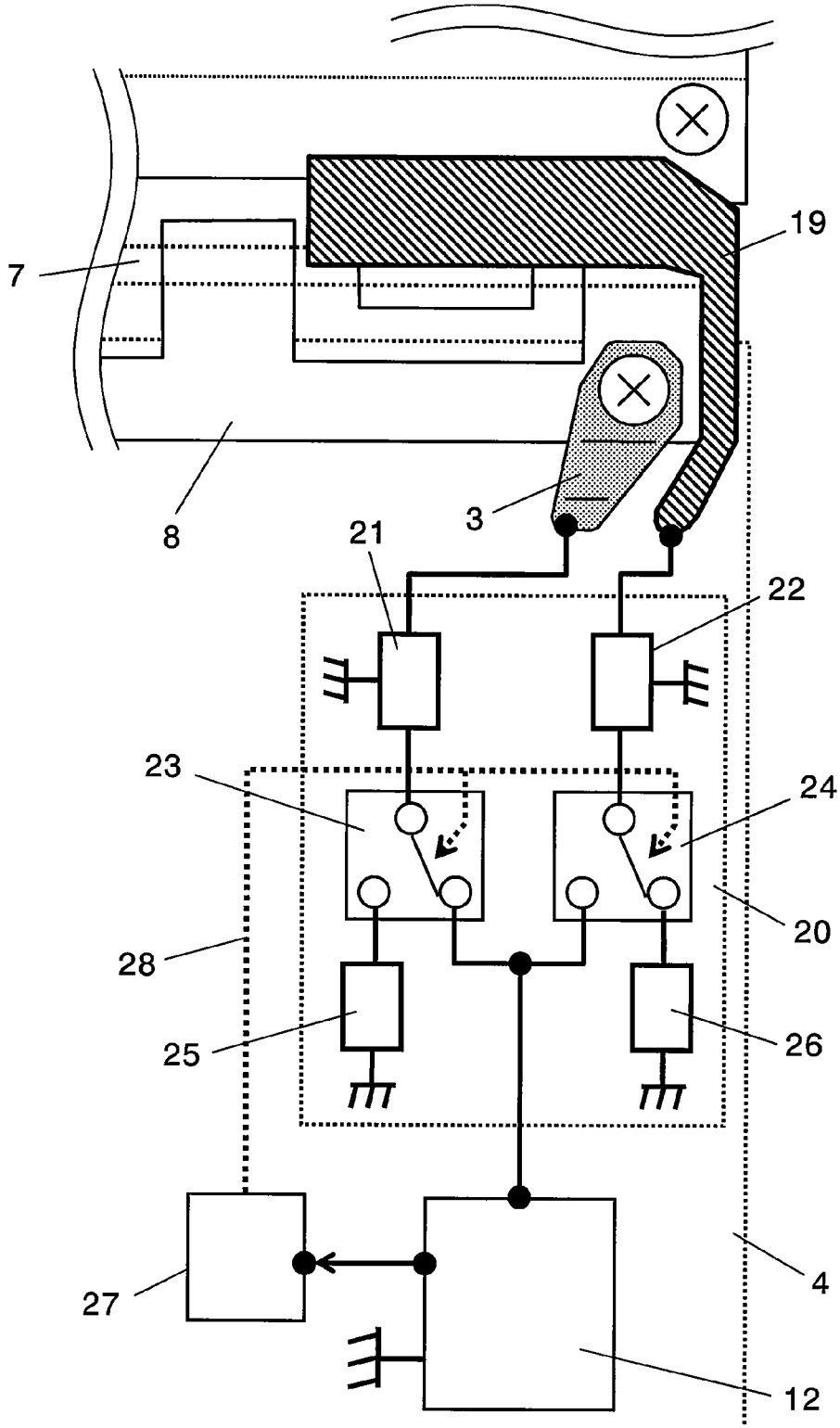
FIG. 7 illustrates the structure of an antenna control circuit section when the cases of the folding portable wireless unit of Embodiment 3 of the present invention are opened.
Figure 8:
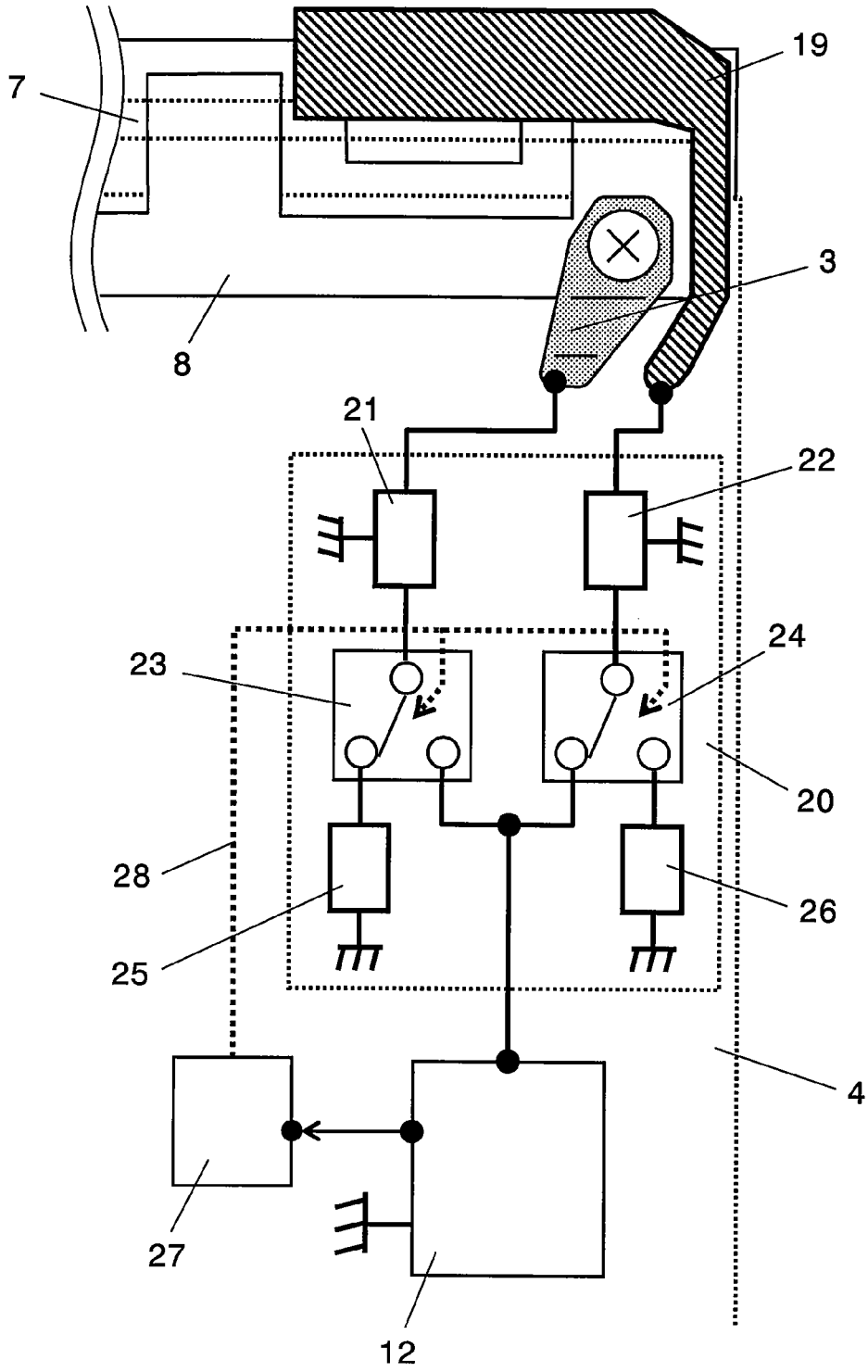
FIG. 8 illustrates the structure of an antenna control circuit section when the cases of the folding portable wireless unit of Embodiment 3 of the present invention are closed.

FIG. 7 and FIG. 8 illustrate the structure of antenna control circuit section 20. Antenna control circuit section 20 is composed of: matching circuit 21, matching circuit 22, high-frequency switch 23, high-frequency switch 24, termination reactance element 25, and termination reactance element 26.

FIG. 7 illustrates a state where feedpoint terminal 3 is selected while the upper case and the lower case of the folding portable wireless unit are opened. In this status, feedpoint terminal 3 is connected to wireless circuit 12 via matching circuit 21 and high-frequency switch 23. An antenna operation in this state is almost the same as that shown in FIGS. 1A and 1B and metal frame 1, hinge section 2, and circuit board 4 function as a dipole antenna.

Antenna element 19 is grounded at termination reactance element 26 via matching circuit 22 and high-frequency switch 24. Then, the value of termination reactance element 26 is adjusted so that impedance when matching circuit 22 is seen from antenna element 19 of matching circuit 22 is reduced (i.e., antenna element 19 is short-circuited to the ground pattern on circuit board 4).

The structure as described above allows, as in conductor element 14 in FIGS. 1A and 1B, antenna element 19 to almost function as a quarter-wave ground wire. Thus, the antenna gain in a calling state can be increased.

Then, control circuit 27 detects a reception level of wireless circuit 12 to switch high-frequency switch 23 and high-frequency switch 24 so that an antenna element having a higher reception level is selected. In the state where the cases are opened, a higher antenna performance is obtained when feedpoint terminal 3 is selected. Thus, in the state where the cases are opened, the structure as described above always controls high-frequency switch 23 and high-frequency switch 24 to be in the state as shown in FIG. 7.

Next, the function in the state where the cases are closed will be described with reference to FIG. 8. In this state, antenna element 19 is connected to wireless circuit 12 via matching circuit 22 and high-frequency switch 24. Feedpoint terminal 3 is grounded at termination reactance element 25 via matching circuit 21 and high-frequency switch 23.

Then, the value of termination reactance element 25 is adjusted so that impedance when matching circuit 21 is seen from feedpoint terminal 3 of matching circuit 21 is reduced (i.e., feedpoint terminal 3 is short-circuited to the ground pattern on circuit board 4). The structure as described above prevents antenna element 19 from being influenced by feedpoint terminal 3 and hinge metal member 8. Thus, antenna element 19 can have a higher antenna performance.

In the state where the cases are closed, metal frame 1 shown in FIGS. 5A and 5B is adjacent to circuit board 4 while being in parallel with circuit board 4, which causes a reduced antenna performance when feedpoint terminal 3 is selected. Thus, in the state where the cases are closed, the state shown in FIG. 8 is controlled so that antenna element 19 is always selected.

As described above, according to the folding portable wireless unit of Embodiment 3, the antenna element 19 in the case-closed state functions as a ground wire to provide a high antenna performance in a calling state and the antenna element 19 in the case-closed state functions as an antenna to provide a high antenna performance.

The position at which antenna element 19 is provided is not limited to that shown in Embodiment 3. Antenna element 19 also may be provided at any position so long as the position provides high antenna gains both in a calling state where upper case 9 is opened at an upper end of lower case 10 and a state where upper case 9 is closed. Specifically, antenna element 19 is desirably provided, from the viewpoint of an improved antenna performance, in the vicinity of hinge metal member 8 so that distance h2 therebetween is maximized (e.g., 5 mm or more) and so that antenna element 19 is prevented from being gripped by a hand of a user when a calling state where upper case 9 is opened.

Antenna element 19 may have a width of about 1 mm for example. However, this width of about 1 mm causes a relatively narrow bandwidth of an operating frequency. Thus, antenna element 19 desirably has a wider width so that the bandwidth can be increased.

Alternatively, a plurality of antenna elements 19 having different lengths also may be provided in order to achieve a plurality of operating frequencies.

Although the above effect by the addition of antenna element 19 can be provided even when reactance element 18 does not exist, this effect is increased when antenna element 19 and reactance element 18 are both added and used.

Although Embodiment 3 has described a structure in which high-frequency switches 23 and 24 are switched depending on a reception level of wireless circuit 12, another structure also may be used where the switching operation is performed depending on a detected communication quality such as a bit error rate for example.

Another means for detecting open/close state of the cases also may be used such as the one that uses a hall element and a permanent magnet to connect, in the case-opened state, feedpoint terminal 3 to wireless circuit 12 to short-circuit antenna element 19 and to short-circuit, in the case-closed state, feedpoint terminal 3 so that antenna element 19 is connected to wireless circuit 12.

Still another means also may be used such as the one that detects an operation mode such as a calling state or a waiting state to control, based on the detected state, the selection of feedpoint terminal 3 or antenna element 19.

INDUSTRIAL APPLICABILITY

As described above, the present invention can be applied to folding mobile telephones and other folding portable wireless units because a high antenna performance can be obtained in a calling state and thus the calling quality can be improved and a high antenna performance also can be obtained even in a state where the cases are closed and thus the waiting sensitivity can be improved.

The invention claimed is:

1. A folding portable wireless unit including an upper case and a lower case connected via a hinge section so that the upper case and the lower case can be opened or closed, comprising:

an upper case antenna element provided in the upper case;

a feedpoint section for feeding with power from a circuit board provided in the lower case to the upper case antenna element; and a conductor element having an electrical length resonant with an operating frequency, one end of the conductor element being electrically connected to a ground pattern of the circuit board and the other end of the conductor element being open;

wherein the hinge section is formed of conductive metal, the upper case antenna element is fed with power from the circuit board via the feed point section provided on one side end of the hinge section, and the other side end of the hinge section is electrically connected with the ground pattern of the circuit board via a reactance element set to have a predetermined value.

2. The folding portable wireless unit according to claim 1, wherein the conductor element is provided in the vicinity of an upper end of the lower case of a body of the folding portable wireless unit.

3. The folding portable wireless unit according to claim 1, wherein the conductor element is provided in parallel with a width direction of a body of the folding portable wireless unit.

4. The folding portable wireless unit according to claim 1, wherein the folding portable wireless unit includes a short-circuit section for short-circuiting the feedpoint section to the ground pattern of the circuit board.

5. A folding portable wireless unit including an upper case and a lower case connected via a hinge section so that the upper case and the lower case can be opened or closed, comprising:

an upper case antenna element provided in the upper case;

a feedpoint section for feeding with power from a circuit board provided in the lower case to the upper case antenna element;

a sub antenna element provided in the vicinity of the hinge section; and a short-circuiting section for short-circuiting the sub antenna element to a ground pattern of the circuit board, wherein the sub antenna element functions as an antenna in a state where the upper case and the lower case are closed, the hinge section is formed of conductive metal, the upper case antenna element is fed with power from the circuit board via the feed point section provided on one side end of the hinge section, and the other side end of the hinge section is electrically connected with the ground pattern of the circuit board via a reactance element set to have a predetermined value.

6. The folding portable wireless unit according to claim 5, wherein the folding portable wireless unit includes:

a communication quality detector for detecting a communication quality of a wireless circuit section; and a controller that switches, based on the detection result by the communication quality detector, the sub antenna element to be short-circuited to the ground pattern of the circuit board or the feedpoint section to be short-circuited to the ground pattern of the circuit board.

7. The folding portable wireless unit according to claim 5, wherein the folding portable wireless unit includes:

an open/close detector for detecting an open or close state of the upper case and the lower case; and a controller that switches, based on the detection result by the open/close detector, the sub antenna element to be short-circuited to the ground pattern of the circuit board or the feedpoint section to be short-circuited to the ground pattern of the circuit board.

* * * * *